US006219867B1

(12) United States Patent
Yates

(10) Patent No.: US 6,219,867 B1
(45) Date of Patent: Apr. 24, 2001

(54) CUSHION PAD WITH ENHANCED CONFORMABILITY

(76) Inventor: Paul M. Yates, 5814 Briar Tree Dr., LaCanada, CA (US) 91011

( * ) Notice: Subject to any disclaimer, the term of this patent is extended or adjusted under 35 U.S.C. 154(b) by 0 days.

(21) Appl. No.: 09/285,894

(22) Filed: Apr. 8, 1999

(51) Int. Cl.[7] ..... F16M 11/16; A61F 7/00

(52) U.S. Cl. ..... 5/655.5; 5/909; 248/118; 248/918

(58) Field of Search ..... 5/654, 655.5, 909, 5/676; 248/118, 118.1, 918; 428/13, 321.5

(56) References Cited

U.S. PATENT DOCUMENTS

| | | | | |
|---|---|---|---|---|
| 4,200,561 | | 4/1980 | Chang | 260/23 H |
| 4,924,634 | * | 5/1990 | Saloff et al. | 5/655.5 X |
| 5,121,962 | * | 6/1992 | Weber et al. | 5/909 |
| 5,445,858 | * | 8/1995 | Nwoko | 5/909 |
| 5,679,193 | | 10/1997 | Yates | 156/145 |
| 5,713,544 | | 2/1998 | Wolf et al. | 248/118 |
| 5,756,184 | | 5/1998 | Yates | 428/188 |
| 5,826,841 | * | 10/1998 | Lavore | 248/118 |
| 5,980,143 | * | 11/1999 | Bayer et al. | 248/118.1 X |
| 6,050,964 | * | 4/2000 | Yates | 248/118 |

* cited by examiner

*Primary Examiner*—Michael F. Trettel
(74) *Attorney, Agent, or Firm*—Walter A. Hackler

(57) ABSTRACT

A wrist cushion includes an elastomer having the physical properties of flexibility and compressibility in the range of flexibilities and compressibilities of stable isomer block polymer gels, with the elastomer having a top surface and a cavity therein. A film is provided for encapsulating the elastomer with the film having physical properties of flexibility to enable uninhibited flexure and compression of the elastomer by a user. A liquid or thixotropic gel is provided and disposed in the elastomer cavity for enhancing lateral top surface movement of the elastomer upon shear force applied thereto by a user.

19 Claims, 1 Drawing Sheet

FIG. 1.
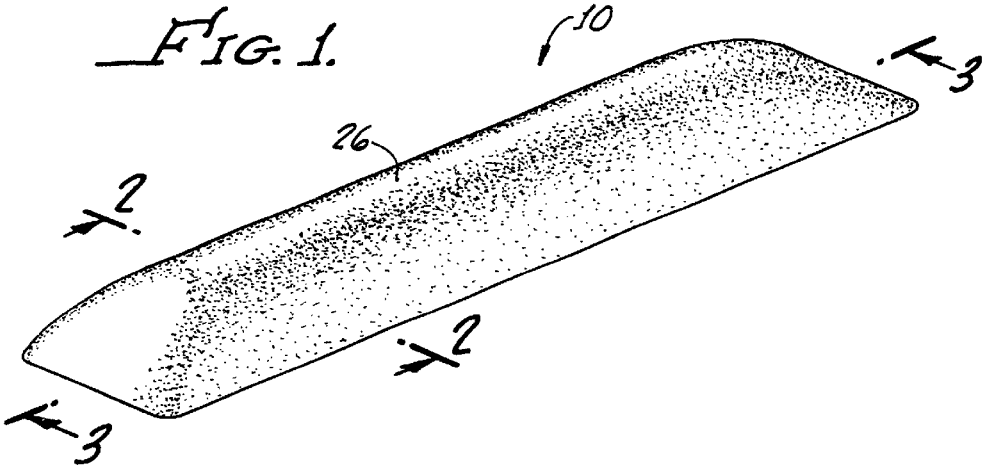
FIG. 2.
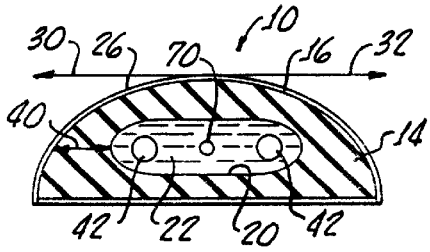
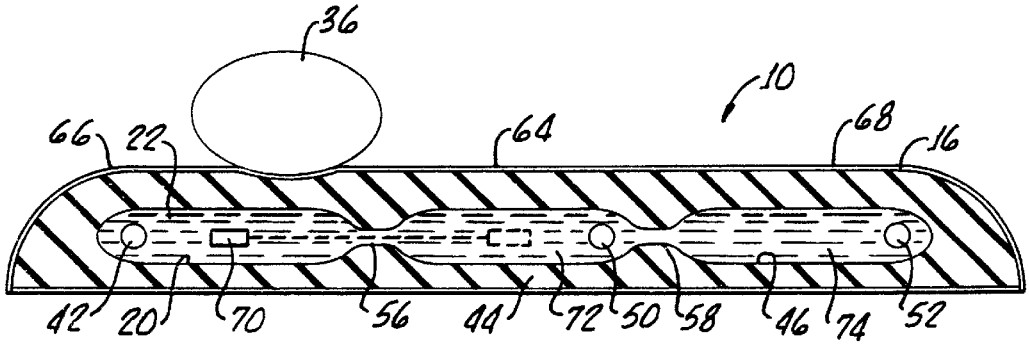
FIG. 3.

CUSHION PAD WITH ENHANCED CONFORMABILITY

The present invention generally relates to cushions and is more particularly directed to a cushion pad having enhanced conformability. Still more particularly the present invention is directed to a keyboard wrist pad having different zones of lateral movement and conformability.

Many cushions or pads for the support of a user are more suitable if the user does not have to slide along the pad in order to accommodate a change of position of a user's arm, leg or hand. That is, it is preferable that the pad accommodate such movement by lateral movement of the pad surface in contact with the user and or a change in conformability of the pad. This is particularly true in the case of keyboard wrist cushions or pads.

A number of cushions have been developed for use along the front edge of a keyboard, which is operated by a user's fingers or hand, such as in the case of a computer mouse.

Proper support is necessary, particularly in conjunction with repetitive computer keyboard operation, in order to prevent a number of medical problems which have been generally known as "carpal tunnel syndrome". A great number of cushions have been developed which provide layers of cushioning materials, including gels. Many attempts have been made to enlarge the degree of movement of a supported wrist relative to the surface on which the wrist is supported. For example, see U.S. Pat. No. 5,713,544 which utilizes a pad having a layer of stable isomeric block polymer gel, in order to afford supporting a user's wrist and afford significant motion on the top surface of the pad, with the supported wrist relative to a bottom surface of the pad in a horizontal plane.

While greater lateral movement is afforded by a wrist rest assembly as set forth in the hereinabove referenced patent, the use of gels alone is limiting in the amount of lateral movement possible.

The present invention is directed to a cushion which provides wide lateral movement support, in addition to providing amusement for the user due to the internal structure of the cushion.

SUMMARY OF THE INVENTION

A cushion pad in accordance with the present invention generally includes an elastomer having the physical properties of flexibility and compressibility in the range of flexibilities and compressibilities of stable isomeric block polymer gels. The elastomer includes an exterior surface and a cavity therein along with film means for encapsulating the elastomer. The film means includes the physical properties of flexibilities to enable uninhibited flexure and compression of the elastomer by a user.

Importantly, means, disposed in the elastomer cavity, is provided for enhancing exterior surface movement of the elastomer upon shear force applied thereto by the user and for enhancing conformity of the pad upon compressive force applied thereto by the user.

In one embodiment of the present invention, the means for enhancing exterior surface movement and enhancing conformity of the pad comprises a thixotropic gel disposed in the elastomer cavity. The thixotropic property of the gel enables the gel to become fluid when force is applied and then becomes semisolid again.

The combination of the elastomer and thixotropic gel provides best conformity when the elastomer has a thickness, measured between the exterior surface and the cavity of at least about ½ inch to about 2 inches.

Further, the film means, elastomer and thixotropic gel may be transparent, thus enabling observance of a decorative object suspended within the thixotropic gel.

In another embodiment of the present invention, the means for enhancing exterior surface movement and enhancing conformity of the pad cushion comprises a liquid. In addition, the cushion pad in accordance with the present invention may include a polyurethane film having a thickness of between about 1 mil and about 5 mils. These limitations are important in providing the required physical properties of flexibility to enable uninhibited flexure and compression of the elastomer by a user as hereinabove noted.

Still more particularly, the elastomer has a thickness measured between the top surface and the cavity of at least about 1 inch. This thickness is important in establishing the resilient properties of the wrist cushion. With the thickness range as hereinabove cited, the wrist cushion retains the elasticity, resilience and compressibility of the elastomer material, despite the liquid filled cavity. Further, this thickness provides a means for enabling self-sealing in order to prevent the liquid from. leaking or reaching the exterior surface.

Accordingly the liquid, or thixotropic, filled cavity enables the wide lateral movement provided by the keyboard wrist cushion in accordance with the present invention.

In one embodiment of the present invention, air pockets disposed in the elastomer cavity provide a means for controlling, in combination with the elastomer, the overall compressibility of the wrist cushion. Because the air pockets are compressible, they can be used to modify the compressibility of the liquid, or thixotropic gel-filled cavity, of course, in combination with the elastomer itself.

Also, in accordance with the present invention, the film, elastomer and liquid, a thixotropic gel, may be transparent and the wrist cushion further comprises decorative objects suspended in the liquid within the cavity. The transparency enables the visual observation of the decorative objects by the user, particularly when used by the user as hereinabove noted.

The decorative objects can be moved within the cavity and liquid, a thixotropic gel, by compression forces applied to the cushion by the user. This movement is enhanced when used in combination with air pockets in the cavity.

Further, in accordance with the present invention, the elastomer includes a plurality of cavities therein, each of which may include a decorative object. In addition, at least one of the elastomeric cavities may be connected with another cavity for enabling movement of the decorative objects within the liquid from one cavity to another by compressive forces applied to the cushion by the user. In addition, multiple cavities enable general control of the resiliency of the cushion.

In yet another embodiment of the present invention, a keyboard wrist pad is provided which includes an elastomer having the physical properties of flexibility and compressibility in the range or flexibilities and compressibilities of stable elastomeric block polymer gels, the elastomer has a top surface and means defining a plurality of cavities therein, for controlling lateral top surface movement of different zones of said elastomer upon shear force applied thereto by a user.

Film means are provided for encapsulating said elastomer, said film means having physical properties of flexibility to enable uninhibited flexure and compression of said elastomer by the user.

Importantly, thixotropic or liquid means, disposed in each of the elastomer cavities is provided for enhancing the lateral top surface movement of said elastomer upon shear force applied thereto by the user and for enhancing conformity of the pad upon compressive force applied thereto by the user.

BRIEF DESCRIPTION OF THE DRAWINGS

The present invention may be more clearly understood with reference to the following detailed description in conjunction with the appended drawings, of which:

FIG. 1 is a perspective view of the present invention;

FIG. 2 is a cross sectional view of the cushion shown in FIG. 1 taken along the line 2—2 showing in cross section any elastomer encapsulated by a film, with the elastomer having a cavity therein, which is liquid filled; and FIG. 3 is a cross sectional view of the cushion shown in FIG. 1 taken along the line 3—3 showing a plurality of interconnected separate elastomer cavities along with a decorative object which may be moved from one cavity to another, as shown in dash line, by compressive forces from a user's wrist.

DETAILED DESCRIPTION

With reference to FIG. 1, there is shown a cushion pad 10 in accordance with the present invention, which, as is more particularly shown in FIG. 2, includes an elastomer 14 and a film 16 which provides a means for encapsulating the elastomer.

In a generally elongate configuration, as shown in the Figures, the pad is suitable for a keyboard wrist pad. It should be appreciated, however, that other pad shapes (not shown) may be utilized depending on the intended use of the pad.

A cavity 20 formed within the elastomer 14, may include either a thixotropic gel or a liquid which provides a means for enhancing lateral exterior or top surface 26 movement (as indicated by arrows 30, 32) upon shear force applied to the surface 26 by a user and enhancing conformity of the pad 10 upon compressive force applied to the surface 26 by the user.

Encapsulation of the elastomer is important for providing a desired textured surface as well as preventing any leakage of plasticizing oil which may be utilized in the elastomer.

The elastomer 14 may be of any suitable type such as, for example, a stable isomeric block polymer gel similar to the gel described in U.S. Pat. No. 3,676,387. This patent is incorporated herewith in its entirety for the purpose of describing a suitable type of gel for incorporation into the present invention.

Generally, the gels are of polymer-oil combinations. Specifically, the elastomer 14 has the physical properties of flexibility and compressibility in the range of flexibilities and compressibilities of the stable elastomer block polymer gels such as set forth in U.S. Pat. No. 3,676,387.

With reference to FIGS. 2 and 3, the transparent film 16 may be of urethane, or polyurethane film, which encapsulates the transparent elastomer 14. The film 16 thickness as hereinabove noted is preferably between about 1 mil and about 5 mils in order to encapsulate the elastomer 14, yet have a resiliency which enables free gel-like movement, or compression, or depression of the elastomer 14 by a user's wrist 36. See FIG. 3.

That is, the film 16 has physical properties of flexibility because of its thickness to enable uninhibited flexure and compression of the elastomer 14 by the user 36. Film 16 thickness beyond this range has not been found to be effective in maintaining the gel-like property of the elastomer 14 while providing encapsulation of the elastomer 14.

As hereinabove noted, the elastomer 14 includes a cavity 20 which is filled with thixotropic gel, a colloid, or a liquid 22, preferably an oil, such as, for example, a mineral oil. The colloid may be a suspension of solids in liquid or an emulsion of two liquids which have properties suitable for enhancing conformity of the pad 10 upon compressive force applied thereto by the user.

The thixotropic gel may be any suitable thixotropic gel such as, for example, described in U.S. Pat. No. 4,200,561, which is incorporated herewith in it's entirety for the purpose of describing suitable thixotropic gels. The gel or liquid 22 filled cavity 20 enhances the lateral top surface movement indicated by the arrows 30, 32 by a shear force in the direction of arrows 30, 32 applied to the top surface 26 of the cushion 10. A thixotropic gel provides unique properties for the pad 10 because of its being a semisolid colloid when undisturbed, but flowing readily when subjected to stress.

An elastomer, a thickness indicated by the arrow 40, between the cavity 20 and the top surface 26, is greater than about ½ inch to about 2 inches in order to maintain the flexibility and compressibility of the cushion 14. Utilizing an elastomer having a width of about 3 to about 5 inches, a user's wrist can be laterally moved up to about 1 to 2 inches without slipping from the top surface 26.

In addition, an elastomer of this thickness provides a self-sealing feature. If the elastomer is punctured or ruptured in some manner, its resiliency causes closure of the puncture or rupture in order to prevent leakage of the liquid 22 or seepage of the thixotropic gel.

The compressibility of the cushion may be further enhanced by providing air pockets 42 within the cavity 20. Because these air pockets are compressible, the overall feel compressibility and flexure properties of the cushion 10 may be modified. These air pockets take up between about 25% and about 75% of the total volume of the cavity 20. A desirable air pocket volume is about 50% of the total volume.

In order to provide zonal control of cushion 10 resiliency, the cushion 10 may include multiple cavities 20, 44, 46 as shown in FIG. 3, corresponding air pockets 50, 52 being present in the cavities 44, 46 and separated from one another by constricted, narrowing or isthmus areas 56, 58. By incorporation of different size air pockets 42, 50, 52, zonal compressibility properties may be provided across the cushion 10.

Further, the control of lateral movement of the cushion 10 surface 26 is controlled by the size of the various cavities 42, 50, 52. That is, a center portion 64 may have greater lateral motion than side portions, or zones, 66, 68. This is important in providing a controlled lateral wrist movement afforded by the cushion 10 when disposed in front of the keyboard, not shown, to facilitate the striking of certain keys (not shown). Such control may also be afforded by utilizing different liquids or thixotropic gels in the various cavities 42, 50, 52.

In accordance with the present invention, if the cavities are not interconnected liquid may be used in one or more of the cavities 42, 50, 52 along with the thixotropic gel in others of the cavities 42, 50, 52.

Yet another feature of the present invention is shown and illustrated in FIGS. 2 and 3. By utilizing a transparent urethane film 16, elastomer 14 and liquid 22, the viewing of the decorative object 70 disposed and suspended within the liquid 22 can be realized.

Movement of the decorative object 70 within the liquid 20 or, for that matter, within the liquid 72, 74 disposed within the cavities 44, 46, respectively, through the isthmus 56, 58, can be actualized by compressive forces supplied to the cushion top surface 26, at the center zone 64, or side zone 66, 68 by the wrist 36.

Thus, movement of the user's wrist 36, when in an operative compressive relationship with the cushion 10 and providing shear forces thereon to cause lateral movement, also causes a movement of a decorative object 70 within the cavity 20 or between the cavities 20, 44, 46, with such movement being further enhanced by the air pockets 42, 50, 52 disposed respectively in the cavities 20, 44, 46. This feature is also available with the proper selection of the thixotropic gel.

Alternatively, the liquid or gel 22 may be semi-translucent with opaque swirls or the like therein in order to provide a different visual effect.

The process of forming the cushion 10 is through the process set forth in U.S. Pat. No. 5,679,193 entitled, METHOD OF MANUFACTURING A GEL CUSHION; U.S. Pat. No. 5,756,184 entitled, GEL CUSHION; and in U.S. patent application Ser. No. 08/856,775 filed May 15, 1997 entitled, CUSHION MANUFACTURING METHOD. Both of these referenced patents and the application are incorporated herewith in their entirety by this reference thereto, for illustrating the manner in which the gel cushion in accordance with the present invention may be manufactured.

Although there has been hereinabove described a keyboard wrist cushion in accordance with the present invention, for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A cushion pad comprising:

an elastomer having the physical properties of flexibility and compressibility in the range of flexibilities and compressibilities of stable elastomeric block polymer gels, said elastomer having an exterior surface and a cavity therein;

a film for encapsulating said elastomer, said film having physical properties of flexibility to enable uninhibited flexure and compression of said elastomer by a user; and a thixotropic gel, disposed in the elastomer cavity, for enhancing exterior surface movement of said elastomer upon shear force applied thereto by the user and for enhancing conformity of the pad upon compressive force applied thereto by the user.

2. The pad according to claim 1 wherein said elastomer has a thickness, measured between the about exterior surface and the cavity, is between about ½ inch and about 2 inches.

3. The pad according to claim 1 wherein said film, elastomer and thixotropic gel are transparent.

4. The pad according to claim 3 further comprising decorative objects suspended in said thixotropic gel and visible through said film, elastomer and thixotropic gel.

5. The pad according to claim 1 wherein said elastomer comprises a plurality of cavities each having a thixotropic gel disposed therein.

6. A cushion pad comprising:

an elastomer having the physical properties of flexibility and compressibility in the range of flexibilities and compressibilities of stable elastomeric block polymer gels, said elastomer having an exterior surface and a cavity therein;

a film for encapsulating said elastomer, said film having physical properties of flexibility to enable uninhibited flexure and compression of said elastomer by a user; and means, disposed in the elastomer cavity for enhancing exterior surface movement and enhancing conformity of the pad, said means comprising a liquid disposed in the elastomer cavity.

7. The pad according to claim 6 further comprising air pockets, disposed in the elastomer cavity, for controlling, in combination with said elastomer, overall conformability and compressibility of said pad.

8. The pad according to claim 7 wherein the elastomer thickness is between about ½ inch and about 2 inches.

9. The pad according to claim 6 further comprising air pocket means disposed in the elastomer cavity, for controlling, in combination with said elastomer, an overall conformability and compressibility of said pad.

10. The pad according to claim 6 wherein said film, elastomer and liquid are transparent and the cushion further comprises decorative objects suspended in said liquid.

11. The pad according to claim 10 further comprising air pockets, disposed in the elastomer cavity, for enabling movement of said decorative objects within said liquid by compression forces applied to the pad by the user.

12. A keyboard wrist pad comprising:

an elastomer having the physical properties of flexibility and compressibility in the range of flexibilities and compressibilities of stable elastomeric block polymer gels, said elastomer having a top surface and a plurality of cavities therein for controlling lateral top surface movement of different zones of said elastomer upon shear force applied thereto by a user;

a liquid, disposed in each of the elastomer cavities for enhancing the lateral top surface movement of said elastomer upon shear force applied thereto by the user and for enhancing conformity of the pad upon compressive force applied thereto by the user.

13. The pad according to claim 12 wherein said film comprises a polyurethane film having a thickness of between about 1 mil and about 5 mils.

14. The pad according to claim 13 wherein said elastomer has a thickness, measured between the top surface and the cavity of between about ½ inch and about 2 inches.

15. The pad according to claim 14 further comprising air pockets, disposed in at least one of the elastomer cavities, for controlling, in combination with said elastomer, overall conformability and compressibility of said pad.

16. The pad according to claim 15 wherein said film, elastomer and liquid are transparent and the cushion further comprises decorative objects suspended in said liquid of at least one of the cavities.

17. The pad according to claim 16 further comprising air pockets, disposed in the elastomer cavity containing the decorative objects, for enabling movement of said decorative objects within said liquid by compressing forces applied to the cushion by the user.

18. The pad according to claim 12 wherein said film, elastomer and liquid are transparent, the cavities are interconnected and the cushion further comprises decorative objects, suspended in said liquid.

19. The pad according to claim 18 further comprising air pocket pockets disposed in the cavities for enabling movement of said decorative objects between the cavities by compression forces applied to the pad by the user.

* * * * *